343-700 MS AU 254 EX
8/10/82 XR 4,343,976

United States Patent [19]
Nasretdin et al.
[11] 4,343,976
[45] Aug. 10, 1982

[54] ENERGY FEED SYSTEM FOR A MICROWAVE OVEN

[75] Inventors: Mänsur A. Nasretdin; Sten A. E. Ohlander, both of Norrköping, Sweden

[73] Assignee: U.S. Philips Corporation, New York, N.Y.

[21] Appl. No.: 132,469

[22] Filed: Mar. 19, 1980

[30] Foreign Application Priority Data

Mar. 19, 1979 [SE] Sweden ..... 7902407

[51] Int. Cl.³ ..... H05B 6/72
[52] U.S. Cl. ..... 219/10.55 F; 333/238; 343/700 MS
[58] Field of Search ..... 219/10.55 F, 10.55 M, 219/10.55 R; 343/700 MS File, 891, 897; 333/84 M

[56] References Cited

U.S. PATENT DOCUMENTS 3,851,133 11/1974 Dygve et al. ..... 219/10.55 F
4,019,009 4/1977 Kusunoki et al. ..... 219/10.55 F
4,027,133 5/1977 Dyge et al. ..... 219/10.55 F
4,165,454 8/1979 Carlsson et al. ..... 219/10.55 F

FOREIGN PATENT DOCUMENTS 52-58143 5/1977 Japan ..... 219/10.55 F

*Primary Examiner*—Arthur T. Grimley
*Attorney, Agent, or Firm*—Robert T. Mayer; Thomas A. Briody; Bernard Franzblau

[57] ABSTRACT

An energy feed system for microwave ovens includes a substantially symmetrical planar conductor system of the microstrip-line type having a central feeding point where energy from a microwave source is applied to the conductor system. The feeding point is surrounded on all sides by a conducting plate from which a number, preferably four, radial plates extend. Openings are formed between the plates which widen outwardly. The radial plates are surrounded by at least one closed annular conductor which receives energy from the radial plates.

18 Claims, 3 Drawing Figures

ENERGY FEED SYSTEM FOR A MICROWAVE OVEN

Figure 1:
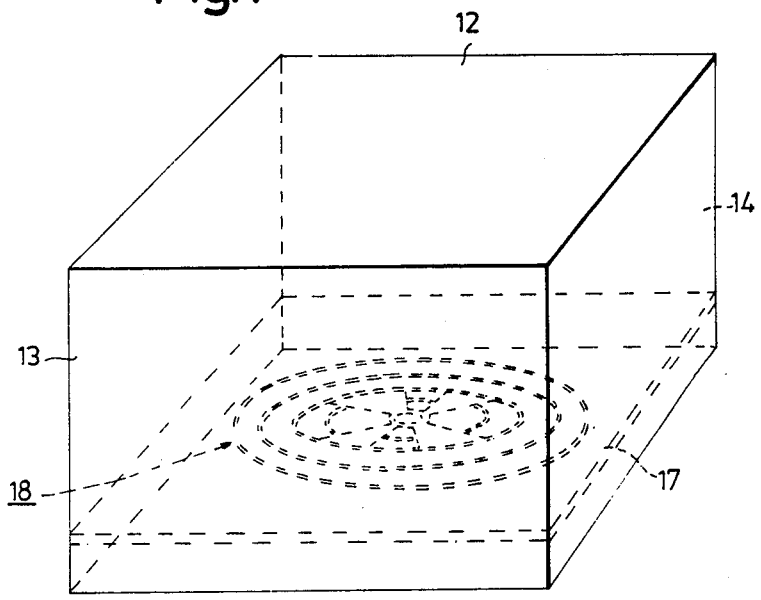

The invention relates to a microwave oven energy feed system for feeding energy from a microwave source to the interior of an oven cavity which is limited by conductive walls. The energy feed system may comprise a substantially symmetrical, planar radiating conductor system of the microstrip-line type arranged in the oven cavity close to a conducting ground plane, preferably the bottom wall of the cavity, and coupled to the microwave source at a central feeding point.

Such a system has been proposed previously, in which the radiating conductor system comprises two coplanar interleaved spiral-shaped conductors extending from the central feeding point where energy from the microwave source is applied to the system. Furthermore, it has already been proposed to construct the conductor system in the form of a plurality of ring-shaped conductors arranged concentrically around the central feeding point and connected to this point by means of a plurality of radial conductors.

A characteristic feature of such an energy feed system comprising a planar radiating conductor system of the microstrip-line type arranged close to a ground plane is that the radiation is highly directed, more specifically almost perpendicularly to the conductive ground plane, i.e. vertically upwards when the bottom wall of the oven cavity is used as the ground plane. In addition, radiant energy is highly concentrated in the central portion of the conductor system and the radiation of energy rapidly decreases in the radial direction towards the peripheral portions of the system. When the substance to be heated is placed in a central position relative to the conductor system and close to it, the radiation passes directly from the central portions into the substance to be heated and is absorbed there. Consequently, the central portion of the system may be considered as operating with direct radiation and the said portion thereof is designated the "direct radiation zone" or "near-field zone". The outermost portions of the system excite the oven cavity itself in the customary manner and as a result the energy is divided into a direct radiation and a space wave radiation.

It appeared, however, that in the previously proposed configurations of the radiating conductor system excessive heating may occur in a limited zone opposite the centre of the conductor system, i.e. opposite the feeding point. During baking, such a local heating may have very adverse effects as the temperature, after the oven has been operative for some time, may rise to such a high value that the properties of the yeast in the strongly heated region are destroyed.

It is an object of the invention to provide a supply system of this type with a conductor system of a different configuration in order to accomplish on the one hand an improved energy distribution within the central direct radiation zone proper and on the other hand an improved balance between the direct wave energy and the space wave energy, while maintaining the principal feature of the division of the energy into a direct wave and a space wave.

According to the invention, this is accomplished in that the central feeding point where microwave energy is fed into the conductor system is surrounded on all sides by a conducting plate. The plate is arranged in the plane of the conductor system and continues at its circumference in a plurality of radially extending conducting plates between which there are interspaces or openings which widen outwardly. These radial plates are surrounded by at least one annular closed conductor receiving energy from the radial plates.

Such a structure, in which a large part of the central portion of the near-field zone is covered by a conducting plate, causes the electromagnetic field produced between the planar conductor system and the ground plane, preferably the bottom wall of the oven cavity, to contribute in the near-field zone to the radiation into the cavity only by way of the openings between the conducting radial plates. Consequently, a larger portion of the energy is forced outwardly to the circumference and will contribute there to the space wave radiation. A very low radiation is obtained exactly opposite the central feeding point where the central conducting plate fully shields the cavity above the conductor system from the space between the conductor system and the bottom wall and from experiments it has appeared that a pronounced "cold" spot is obtained in the centre. Such a dimensioning of the conductor system resulting in a "cold" spot in the centre appeared to be advantageous, as the "cold" spot is heated to a sufficient extent by the surrounding portions by means of thermal equalization. Owing to the described configuration of the conductor system the overheated spot in the centre of the previously proposed embodiments is converted into a "cold" spot and the size and temperature of this spot can be easily adjusted by varying the external dimensions of the central plate. The energy distribution within the near-field zone and the ratio between the direct or near-field radiation and the space wave radiation can be set in a simple manner by varying the dimensions of the said radial plates and the ratio between these plates and the interspaces.

A proper field distribution within the near-field zone proper is obtained by interconnecting the radial plates by means of one or more conductors arranged in the plane of the conductor system.

For reasons of symmetry and simplicity of manufacture, it is advantageous that both the central plate and the annular conductors be circular, the radial plates (and the interspaces) then being formed by circle sectors which are interconnected by arc-shaped conductors.

A preferred embodiment comprising four radial plates is characterized in that the conductor system is arranged in a rectangular or square cavity so that the radial plates are substantially directed towards the corners of the cavity.

It was found that such an arrangement results in the best possible field distribution in the near-field zone, which is possibly caused by the fact that the plates are then at the maximum distance from the conducting walls of the oven cavity, whereby the risk of disturbing standing wave patterns is minimized.

An embodiment in which the radial plates and their interspaces are uniformly distributed around the circumference and are substantially of the same size, that is to say they each cover an angle of approximately 45°, appeared to be a particularly suitable embodiment.

Figure 2:
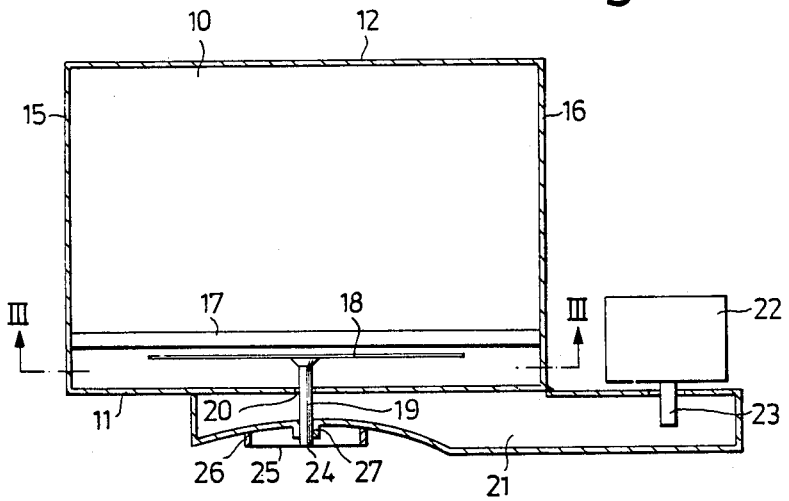
Figure 3:
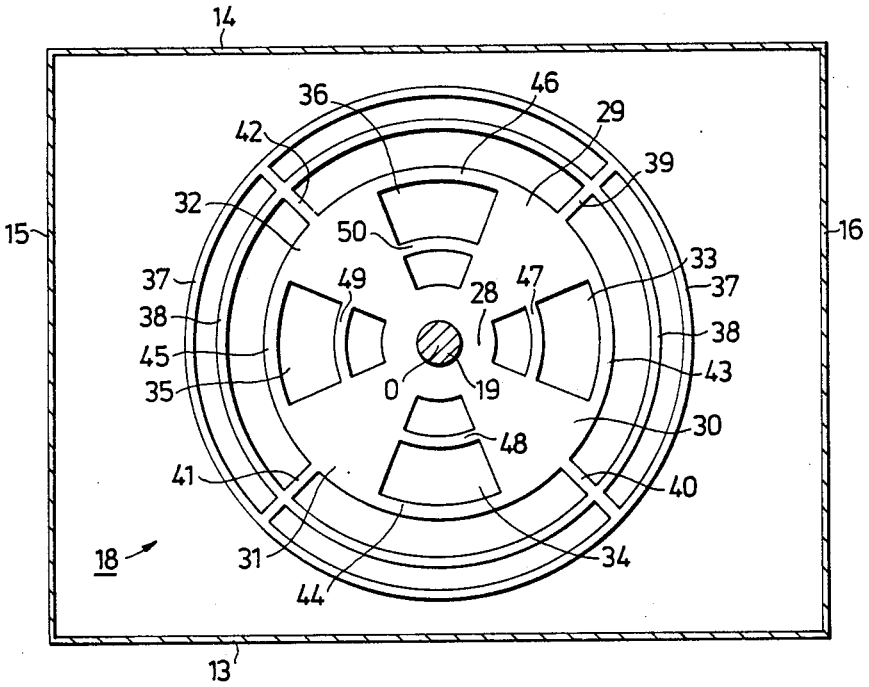

The invention will now be further explained by way of non-limitative example with reference to the accompanying drawings in which:

FIG. 1 is a perspective view of an oven cavity having a conductor system included in a feeding system according to the invention, FIG. 2 shows a vertical sectional view of the microwave oven with feeding system according to the invention, and FIG. 3 shows a horizontal sectional view along the line III—III in FIG. 2 and, more particularly, a preferred embodiment of the transmission line in a true scale.

Reference numeral 10 in the FIGS. 1 and 2 denotes an oven cavity in a microwave oven, the cavity being limited by a bottom plate 11, an upper plate 12, a front wall 13, a rear wall 14 and two side walls 15, 16. The front wall has an opening, not shown, which gives access to the interior of the oven cavity and which can be closed by means of a door. As shown by FIG. 2 a support plate 17 for the food to be heated is placed in the oven cavity and below this plate 17 there is a conductor system 18 in the form of a microstrip transmission line with a metal probe 19. The probe 19 projects through an opening 20 in the bottom plate 11 into and through a waveguide 21 disposed on the bottom side of the bottom plate 11. At the opposite end of the waveguide 21 there is a magnetron 22 with an antenna 23, which also projects into the waveguide.

In order to achieve an optimum coupling between the probe 19 and the waveguide 21, the lower limiting wall of the waveguide is conical or dome-shaped, as shown in FIG. 2, so that the height of the waveguide 21 is very low in the region of the coupling between the probe 19 and the waveguide 21. The height of the waveguide 21 increases gradually with distance to the coupling region, whereas the probe end 24 projecting through the bottom side of the waveguide 21 is short-circuited to the wall of this waveguide by means of a short-circuiting washer 25 and a metal flange 26. At the feed-through 27 in the bottom wall of the waveguide 21 the outside of the probe 19 is coated with an insulating layer, for example, made of polytetrafluoroethylene and sold under the trademark Teflon.

The energy feed system operates as follows: when the magnetron is excited, microwave energy is fed into the waveguide 21 by way of the antenna 23, is propagated by this waveguide and received by the probe 19. This probe 19 passes the microwave energy to the central point in the conductor system 18, from where this energy is radially transmitted outwardly in the conductor system 18 while delivering energy to the food placed on the plate 17 in the centre of the oven cavity. A portion of this energy passes directly into the food and another other portion excites the oven cavity, causing a standing wave pattern in this cavity. The conductor system 10 is rotational-symmetrical and concentric with respect to the probe 19, which represents the feeding point.

FIG. 3 shows clearly that the conductor system 18 comprises a centrally arranged, circular metal plate 28 having the metal probe 19 in its centre and continuing at its circumference with four metal plates 29, 30, 31, 32, which are in the shape of a circle sector. These sector-shaped plates 29–32 define interspaces or openings 33, 34, 35, 36, which also have the shape of circle sectors. In the example shown in this drawing the sector-shaped plates and the interspaces between them are uniformly distributed around the circumference and are equally large, that is to say they each cover an angle of 45°, seen from a common central point 0. The sector-shaped metal plates 29–32 are enclosed by two annular strip conductors 37 and 38 which, in the example shown, are also circular and arranged concentrically with respect to the central point 0. The annular conductors 37, 38 are connected to the sector-shaped metal plates 29–32 by means of four radial, rectilinear strip conductors 39, 40, 41, 42, which extend from the centre of the respective sector-shaped metal plates and which are connected to the conductor 37 as well as to the conductor 38. In addition, there are circle-arc shaped strip conductors 43, 44, 45, 46, which interconnect the sector-shaped metal plates 29–32 at their circumference, and identical circle-arc shaped strip conductors 47, 48, 49, 50, which interconnect the sector-shaped metal plates 29–32 substantially along these sectors. The circle-arc shaped strip conductors 43–46 and 47–50 form, together with the material of the metal plates 29–32, for all practical purposes two interior, annular strip conductors. In the example shown all these annular conductors are concentric with respect to the centre point 0.

In FIG. 3, the symmetrical conductor system 18 is arranged relative to the oven cavity walls in such a way that the centre line of each sector-shaped interspace 33–36 is perpendicular to an oven cavity wall. Thus, the sector-shaped metal plates 29–32 are substantially directed to each corner of the oven cavity.

The system operates as follows: microwave energy applied to the metal probe 19 propagates radially outwardly along the symmetrical conductor system, energy radiating upwardly at the same time, so that the energy along the conductor system decreases continuously from the centre to the circumference. The upward radiation takes place mainly through the interspaces between the plates 29–32 while these plates, and also the conducting, circular plate 28 in the centre, "shield" the radiation and propagate the energy outwardly at the same time. As a result of the conductor system configuration shown, having a comparatively large conducting plate in the centre and outwardly widening conductor plates, which define radiation openings between them and which also widen outwardly, a zone having a uniform upward radiation without pronounced "cold" or "hot" spots (apart from a "cold" spot exactly in the centre) is obtained in this region. As the food is usually placed opposite this zone and very close to the conducting system, the radiation penetrates from this zone directly into the food and the said zone constitutes the "direct radiaton zone" or "near-field zone". The remaining energy propagates to the annular outer conductors 37, 38 and excites the oven cavity. In the embodiment of the conductor system shown in FIG. 3, a satisfactory balance also is obtained between the quantity of energy radiated into the near-field zone and the quantity radiated into the space-field zone.

Suitably, the conductor system may be made in one piece and may be punched from a metal plate. Alternatively, the conductor system may be in the form of metal foil, which is directly fastened to the bottom side of the plate 17, for example by means of a glue, or it may be in the form of a metallized pattern on the bottom side of the plate 17.

The radiating conductor system of the microstrip-line type may be modified in different ways within the scope of the invention, while still maintaining the desired properties of the feeding system. It is therefore not necessary for all annular conductors and metal plate sectors to be of a pure circular shape but, alternatively, they may be elliptical in order to be more suited to a rectangular oven cavity. Alternatively, the "rings" may be rectangular or square, in which case the central plate and also the metal sectors must be rectangular or square. In order to reduce the "cold" spot in the centre the central plate 28 and the sector-shaped metal plates may, if so desired, be provided with small slots.

What is claimed is:

1. A microwave oven comprising, an oven cavity limited by a plurality of conductive walls, and an energy feed system coupling energy from a microwave energy source to the interior of the oven cavity comprising, a substantially symmetrical planar radiating conductor system of the microstrip-line type arranged within the oven cavity close to a conductive ground plane and coupled to the microwave energy source at a central energy feed point for feeding microwave energy into the conductor system, a conductive central plate surrounding the central feed point on all sides and arranged in the plane of the conductor system and having a plurality of radially extending conductive plates at its circumference, openings which widen outwardly being formed between said conductive plates, and at least one annular closed conductor enclosing the radial conductive plates so as to receive energy from said radial plates.

2. A microwave oven as claimed in claim 1 wherein the energy feed system further comprises one or more conductors interconnecting the radial plates.

3. A microwave oven as claimed in claim 2, in which the central plate and the annular conductor are circular, and wherein the radial plates and the openings are in the shape of circle sectors interconnected by means of circular arc-shaped conductors.

4. A microwave oven as claimed in claims 1, 2 or 3 comprising four radial plates and wherein the oven cavity is rectangular, the conductor system being arranged so that the radial plates are substantially directed towards the corners of the oven cavity.

5. A microwave oven as claimed in claim 4, wherein the radial plates and the openings are uniformly distributed about the circumference and are substantially of the same size, each covering an angle of approximately 45°.

6. A microwave oven as claimed in claims 1, 2 or 3 wherein the radially extending plates have a radial extension greater than half the radial dimension of the outermost annular conductor.

7. A microwave oven as claimed in claim 5 wherein the radially extending plates extend radially over a distance greater than half the radial dimension of the outermost annular conductor.

8. A microwave oven as claimed in claims 1, 2 or 3 wherein the radially extending plates extend radially over a distance approximately 0.65 times the radial dimension of the outermost annular conductor.

9. A microwave oven as claimed in claim 4 wherein the radially extending plates extend radially over a distance approximately 0.65 times the radial dimension of the outermost annular conductor.

10. A microwave oven as claimed in claim 1 wherein said conductive ground plane comprises the bottom conductive wall of the oven cavity.

11. A microwave oven comprising a conductive wall structure that defines a oven cavity and includes opposed top and bottom conductive wall surfaces and with an energy feed point centrally located in the bottom wall surface, an energy feed system comprising a symmetrical planar energy radiating transmission line conductor system located within the oven cavity parallel to and adjacent the bottom wall of the oven cavity and symmetrical about the energy feed point, said planar conductor system comprising a conductive plate having a plurality of openings therein bounding an inner central area enclosing the energy feed point, the openings being wider at their outer radial extremities than at their inner radial extremities and defining a plurality of radially extending conductive sectors surrounded by at least one outer annular closed conductor that receives energy via the radial conductive sectors, and means coupling the energy feed system to a microwave energy source via the central energy feed point.

12. A microwave oven as claimed in claim 11 wherein the energy feed system includes a thin elongate conductive probe extending through the central feed point in the bottom wall and connected to the center of the conductive plate, and wherein said coupling means comprises a wave guide into which the probe extends and to which the microwave source is coupled.

13. A microwave oven as claimed in claims 11 or 12 wherein said conductive plate and said inner central area have a circular shape and the openings comprise arcuate sections uniformally circumferentially spaced about the center of the plate and arranged to define circular arc-shaped plate portions interconnecting said radially extending conductive sectors of the plate.

14. A microwave oven as claimed in claims 11 or 12 wherein the oven cavity has a rectangular shape and the openings are uniformly circumferentially spaced so as to define four radial conductive sectors extending respectively in the directions of the four corners of the oven cavity.

15. A microwave oven as claimed in claims 11 or 12 wherein the openings comprise four arcuate sectors uniformly circumferentially distributed to define four uniformly spaced radial conductive sectors, said openings being of the same size and said radial conductive sectors being of the same size with each of said openings and radial conductive sectors defining an angle of approximately 45°.

16. A microwave oven as claimed in claim 13 wherein the radial conductive sectors extend radially for a distance that is more than half the radius of the outermost annular conductor.

17. A microwave oven as claimed in claims 11 or 12 wherein said conductive plate and said inner central area have a circular shape and the openings comprise arcuate sections uniformly circumferentially spaced about the center of the plate and comprising at least two radially spaced and aligned arcuate openings between each adjacent pair of radial conductive sectors, said openings defining a plurality of circular arc-shaped plate portions interconnecting said radial conductive sectors.

18. A microwave oven as claimed in claim 13 wherein said outer annular conductor is concentric to the conductive plate and is connected to the radial conductive sectors via a plurality of uniformly circumferentially distributed radially extending strip conductors whereby the outer annular conductor excites the oven cavity to a resonant condition to produce an energy standing wave pattern which assists a direct near-field radiation pattern, produced by the conductive plate with the openings therein, in heating an object placed within the oven cavity.

* * * * *